US012259208B2

(12) United States Patent
Fisher et al.

(10) Patent No.: US 12,259,208 B2
(45) Date of Patent: Mar. 25, 2025

(54) ADJUSTABLE GAS VALVE FOR FIREARM

(71) Applicant: KNS Precision, Inc., Fredericksburg, TX (US)

(72) Inventors: Daniel Earl Fisher, Fredericksburg, TX (US); Christian Kager Welch, Fredericksburg, TX (US)

(73) Assignee: KNS Precision, Inc., Fredericksburg, TX (US)

( * ) Notice: Subject to any disclaimer, the term of this patent is extended or adjusted under 35 U.S.C. 154(b) by 0 days.

(21) Appl. No.: 18/155,110

(22) Filed: Jan. 17, 2023

(65) Prior Publication Data

US 2023/0228507 A1 Jul. 20, 2023

Related U.S. Application Data

(60) Provisional application No. 63/299,587, filed on Jan. 14, 2022.

(51) Int. Cl.
*F41A 5/28* (2006.01)

(52) U.S. Cl.
CPC ..... *F41A 5/28* (2013.01)

(58) Field of Classification Search
CPC ..... F41A 5/18–30
See application file for complete search history.

(56) References Cited

U.S. PATENT DOCUMENTS

| | | | | | |
|---|---|---|---|---|---|
| 1,802,816 | A * | 4/1931 | Holek | F41A 5/28 | 89/193 |
| 2,369,669 | A * | 2/1945 | Garand | F41A 5/28 | 89/193 |
| 5,272,956 | A * | 12/1993 | Hudson | F41A 5/28 | 89/193 |
| 9,273,916 | B1 * | 3/2016 | Russo | F41A 5/26 | |
| 9,816,769 | B1 * | 11/2017 | Brown | F41A 5/28 | |
| 10,816,288 | B1 * | 10/2020 | Oglesby | F41A 5/28 | |
| 2010/0218671 | A1 * | 9/2010 | Mayberry | F41A 5/28 | 89/192 |
| 2014/0083286 | A1 * | 3/2014 | Gomez | F41A 5/18 | 89/193 |
| 2016/0109200 | A1 * | 4/2016 | Gomez | F41G 1/02 | 89/193 |

FOREIGN PATENT DOCUMENTS

| | | | | |
|---|---|---|---|---|
| CH | 631542 | A5 * | 8/1982 | |
| EP | 167067 | A * | 1/1986 | F41A 5/28 |

* cited by examiner

*Primary Examiner* — Gabriel J. Klein
(74) *Attorney, Agent, or Firm* — Wood Herron & Evans LLP

(57) ABSTRACT

Provided is an adjustable gas valve for use in a firearm gas block having a cylinder and piston. The valve includes valve body configured to associate with the cylinder and has an exhaust port. A regulator adjustably occludes between none and all of the exhaust port.

14 Claims, 14 Drawing Sheets

ADJUSTABLE GAS VALVE FOR FIREARM

RELATED APPLICATIONS

This application claims priority to U.S. Provisional Patent Application No. 63/299,587, filed Jan. 14, 2022, and incorporates the same herein by reference.

TECHNICAL FIELD

This invention relates to an adjustable valve for a gas-operated firearm. More specifically, it relates to an adjustable gas valve that adjustably vents gas pressure from an external piston-cylinder in a gas block.

BACKGROUND

Gas-operated firearms use some of the propellant gas pressure to cycle the action. A port in the barrel's bore allows some of the gas pressure to be diverted into a gas block. In external piston systems, the gas block includes a cylinder to which the gas pressure is directed against a piston to displace it. Various devices have been made to control or limit the gas pressure in the cylinder that operates the piston. In some examples, an orifice size is varied or adjustable to control the flow of gas ported from the bore into the cylinder. In other examples, a portion of the gas pressure may be vented through an exhaust a port in the gas block.

Around 2006, the United States military adopted a weapon system known as the Special Operations Forces Combat Assault Rifle (SCAR). The SCAR design uses an external, short stroke gas piston system with a valve that adjusts the flow of gas into the cylinder and provides an open exhaust vent. This design provides limited adjustments of gas pressure (by restricting gas flow into the cylinder) and has an open exhaust system with no adjustability of the gas pressure vented to atmosphere.

SUMMARY OF THE INVENTION

The present invention provides an adjustable gas valve for use in a firearm gas block having a cylinder and piston. The valve includes valve body configured to associate with the cylinder and has an exhaust port. A regulator adjustably occludes between none and all of the exhaust port.

The present invention provides adjustment to the gas flow from the barrel port into the gas block and/or adjustment of the amount of gas vented to atmosphere. It may also include an interior structure that controls the dynamic flow of gas inside the cylinder and through the exhaust port.

The present invention provides an adjustable gas valve that can, for example, be a replacement for the gas valve in the SCAR system, but that also can be adapted for other weapon platforms.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING FIGURES

Like reference numerals are used to indicate like parts throughout the various drawing figures, wherein.

Figure 5:
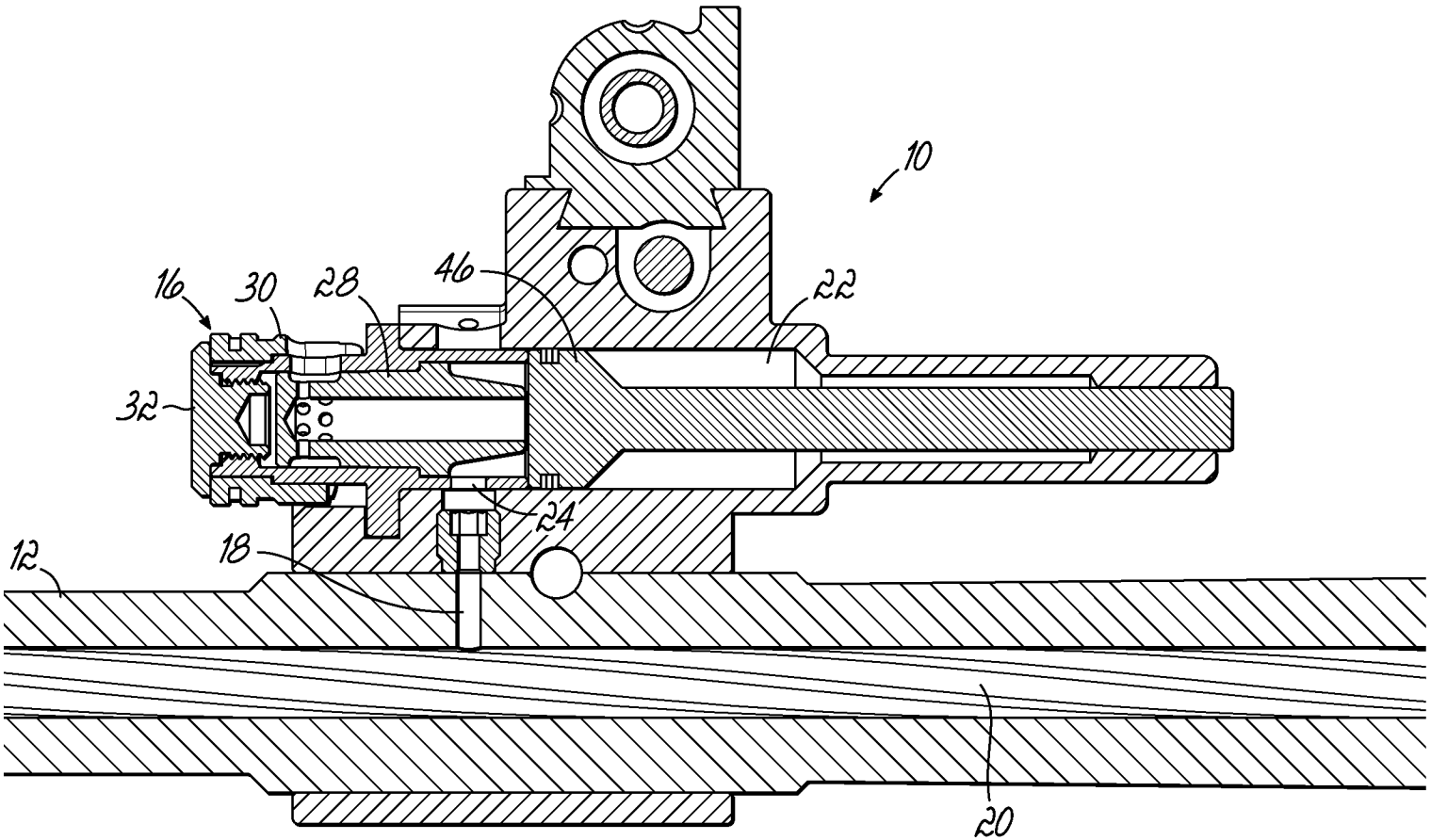
Figure 6:
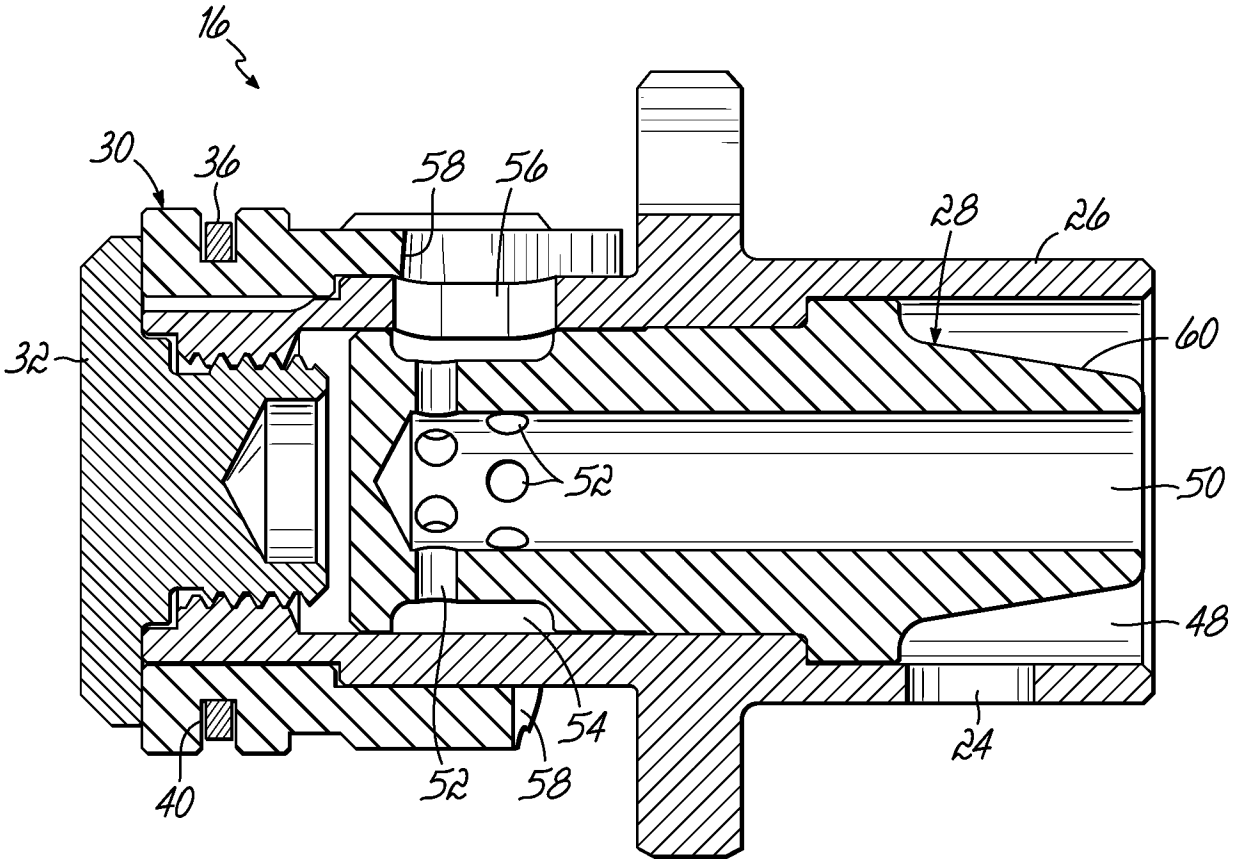
Figure 7:
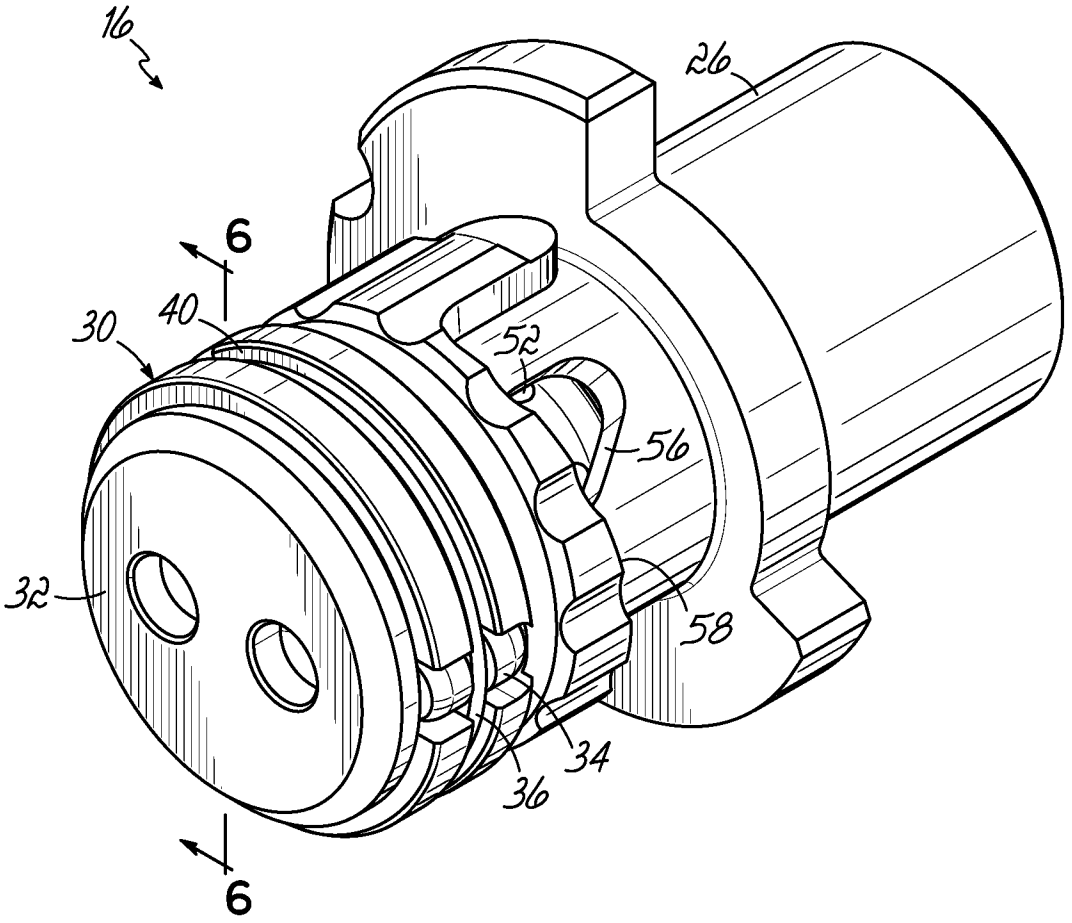
Figure 8:
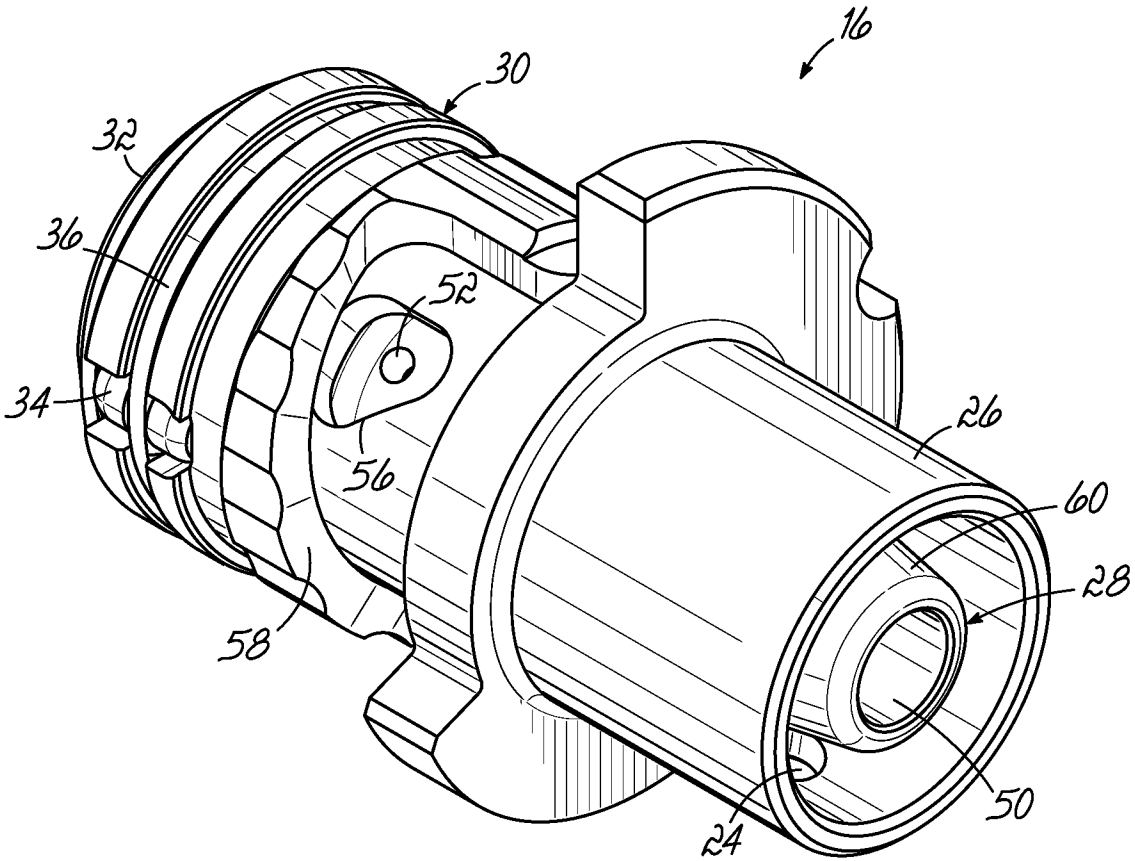
Figure 9:
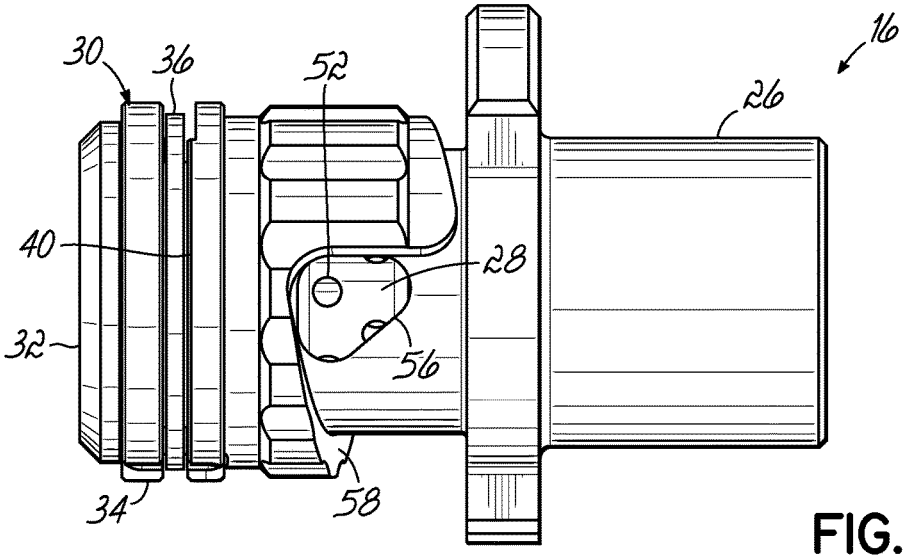
Figure 10:
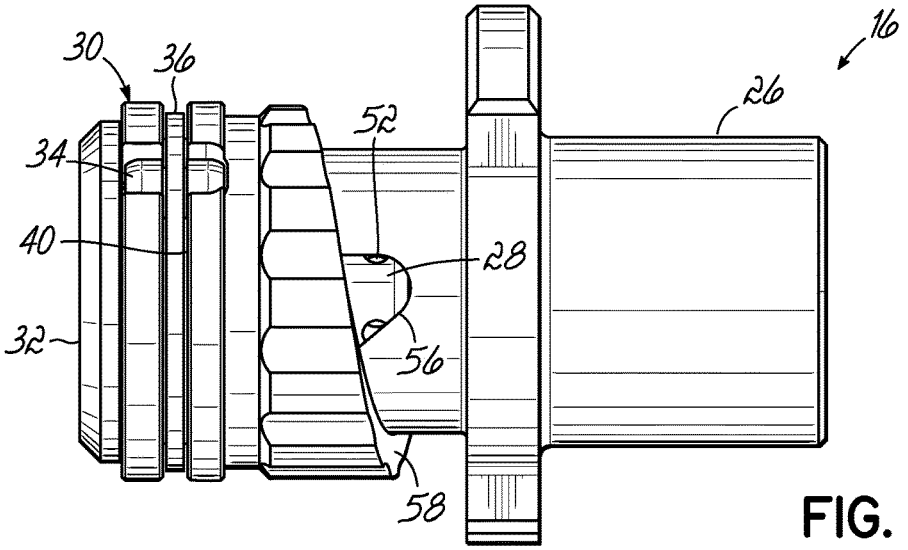
Figure 11:
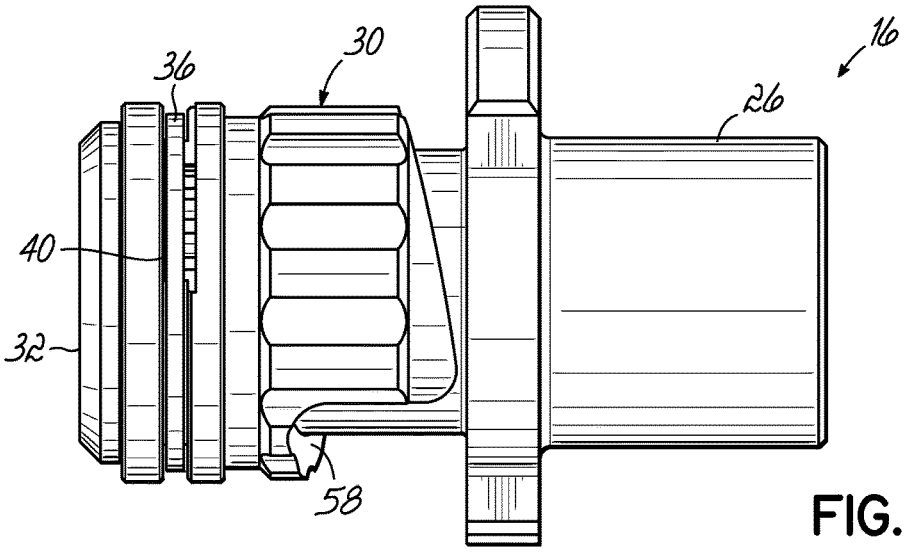
Figure 12:
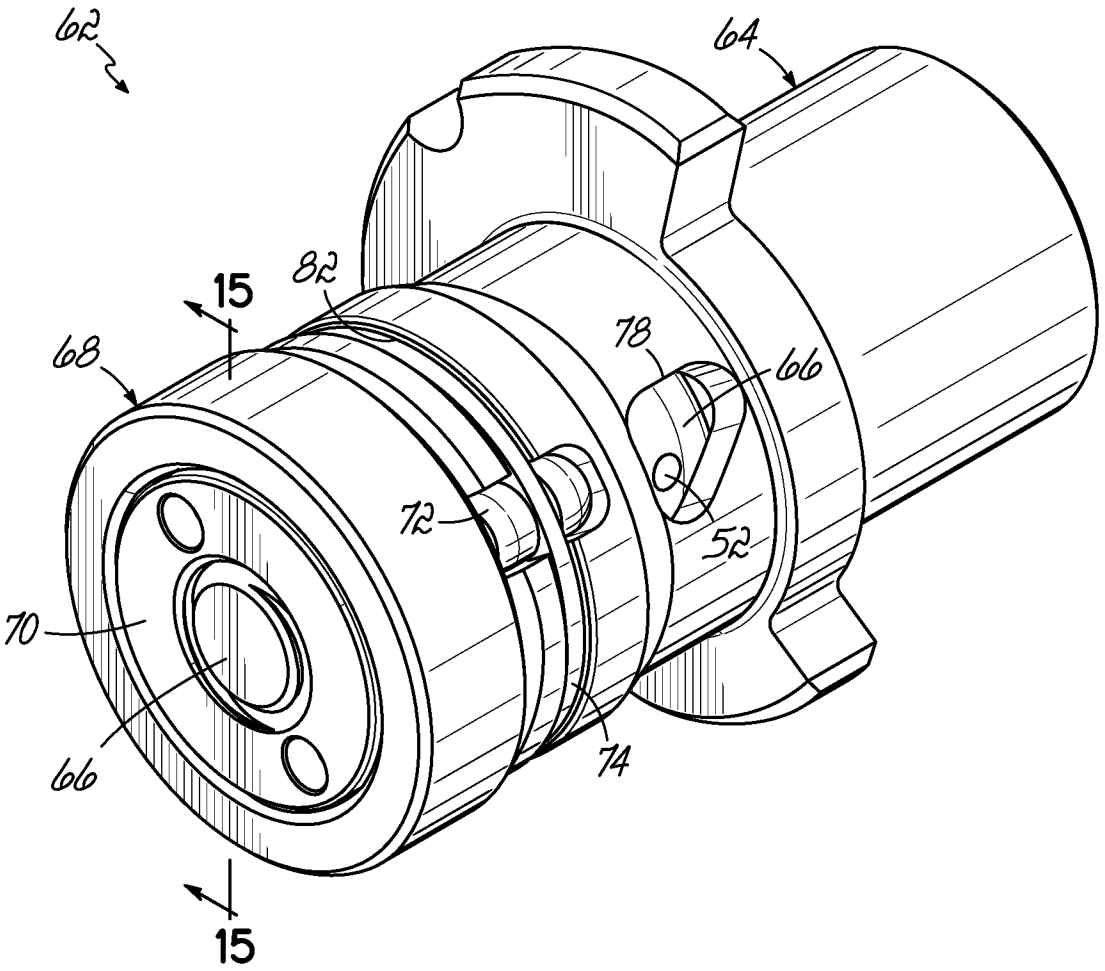
Figure 13:
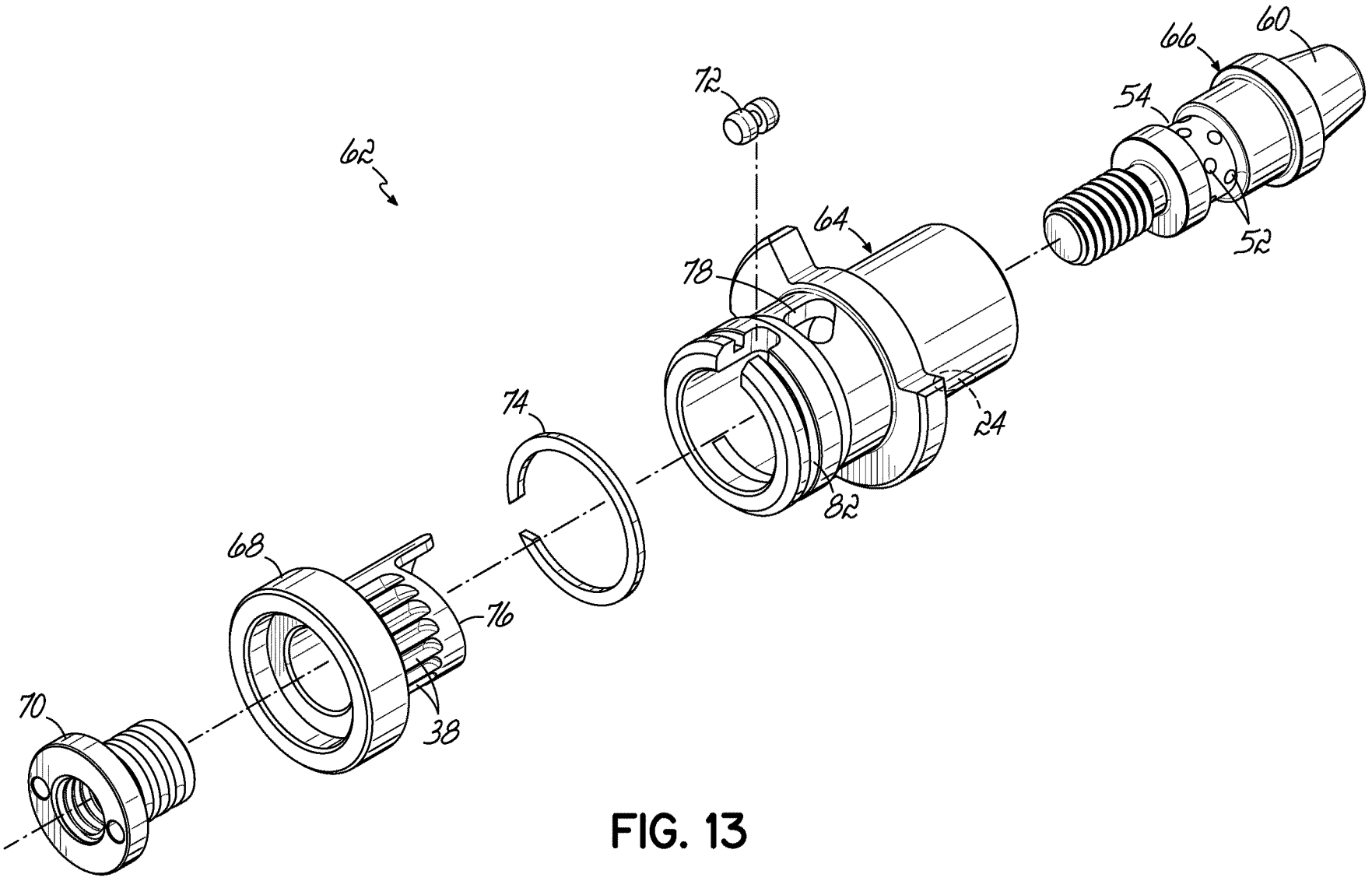
Figure 14:
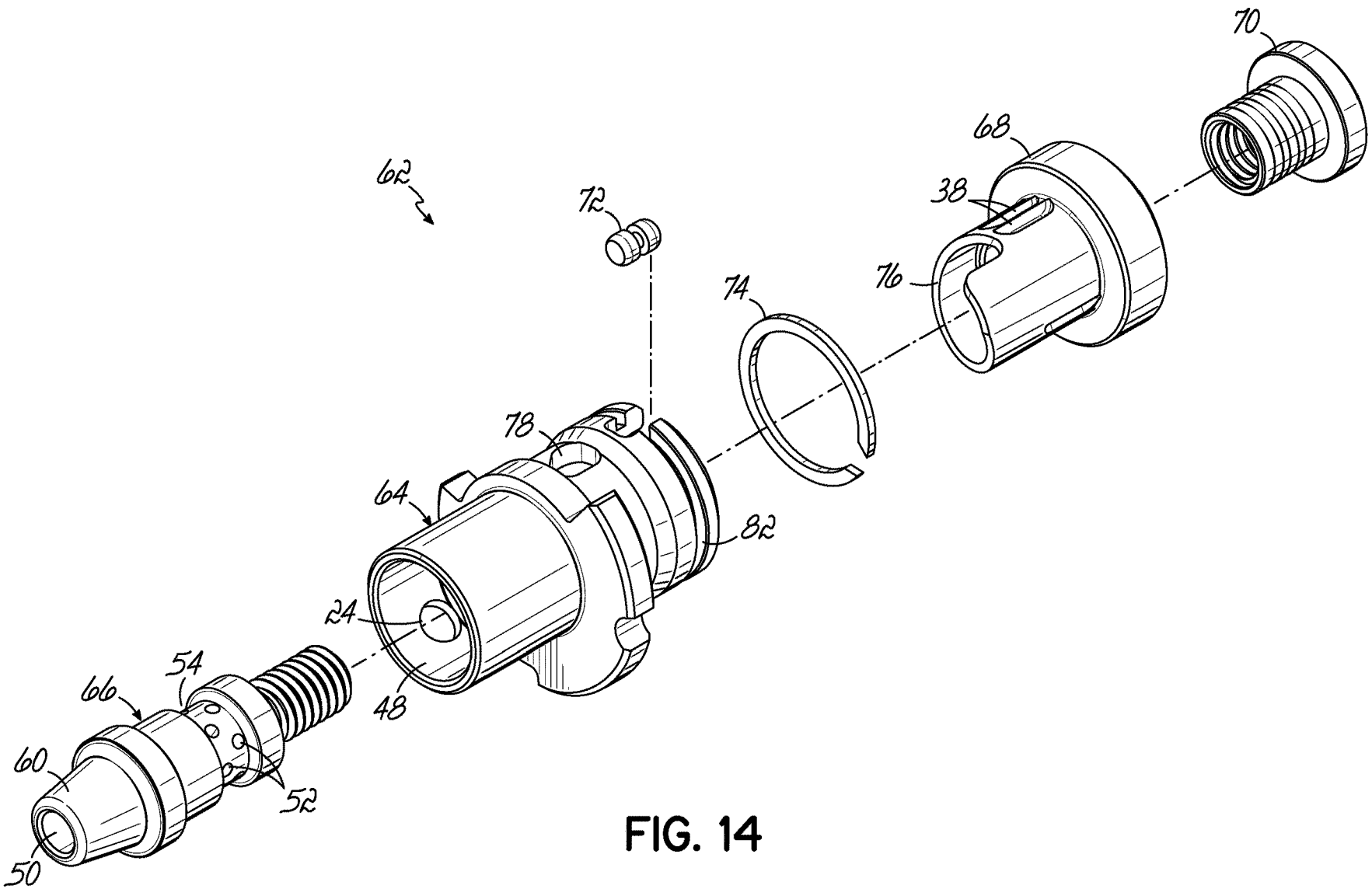
Figure 15:
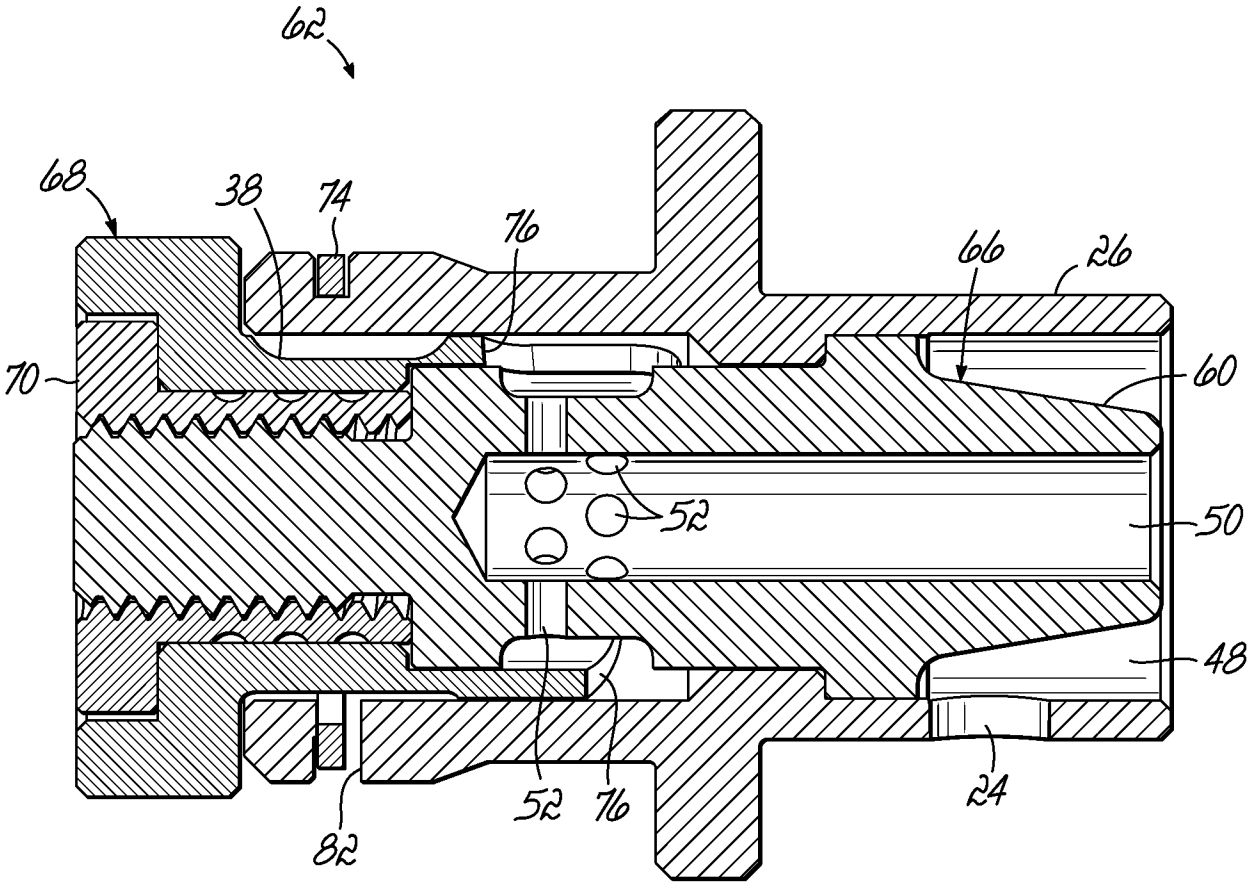
Figure 16:
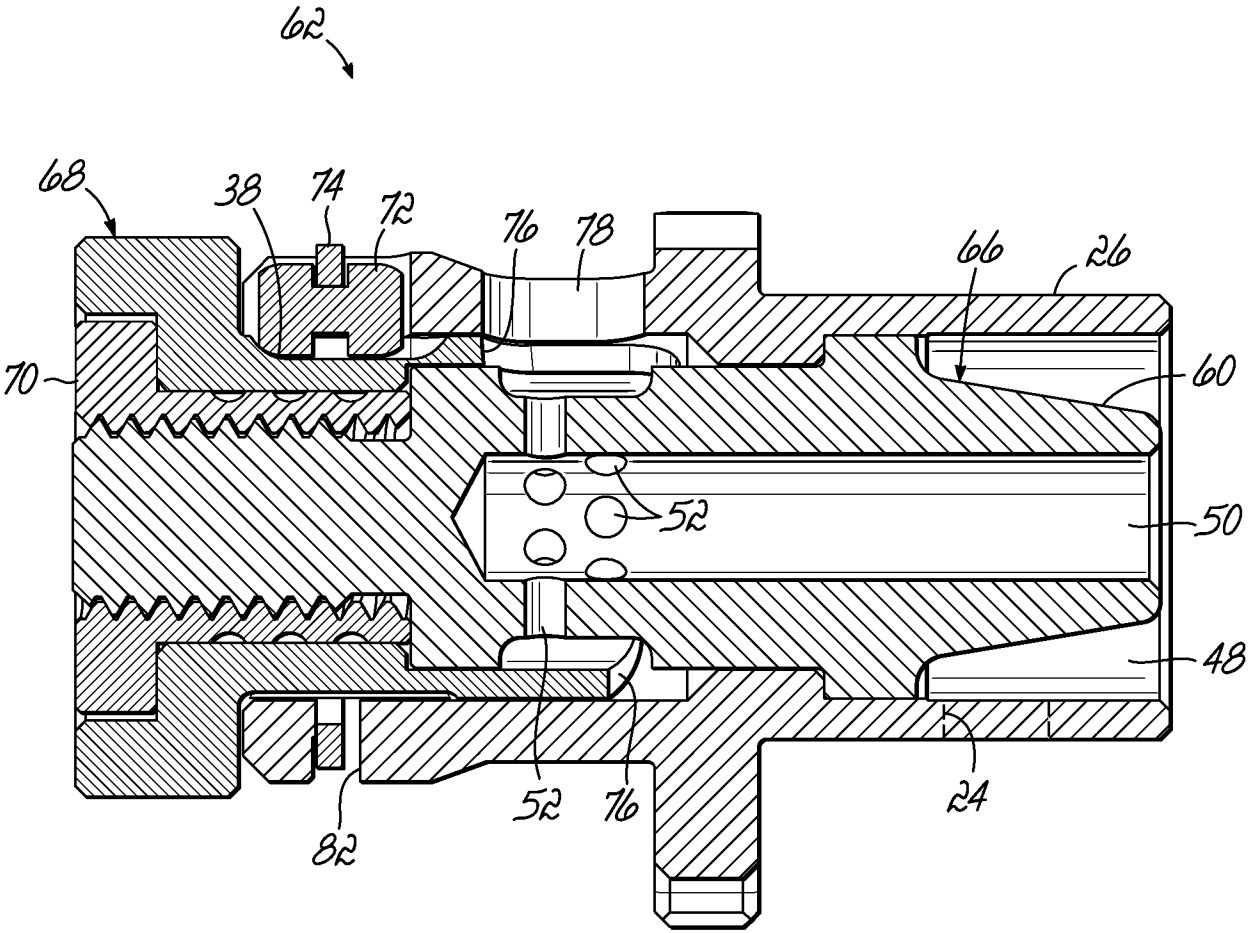

FIG. 5 a similar side sectional view showing the present gas valve mounted in a gas block;

FIG. 6 is an enlarged longitudinal sectional view of the gas valve taken substantially along line 6-6 of FIG. 7;

FIG. 7 is a first enlarged isometric view thereof;

FIG. 8 is a reverse enlarged isometric view thereof;

FIG. 9 is plan view showing the gas adjustment collar in a fully open position;

FIG. 10 is a similar plan view showing the gas adjustment collar in an intermediate (partially open; partially closed) position;

FIG. 11 is a similar view showing the gas adjustment collar in a fully closed position;

FIG. 12 is an isometric view of a gas valve according to a second embodiment of the present invention;

FIG. 13 is an isometric exploded view thereof;

FIG. 14 is an opposite isometric exploded view thereof;

FIG. 15 is a side sectional view thereof taken substantially along line 15-15 of FIG. 12; and FIG. 16 is another side sectional view.

DETAILED DESCRIPTION

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped and held in the ordinary manner.

Figure 1:
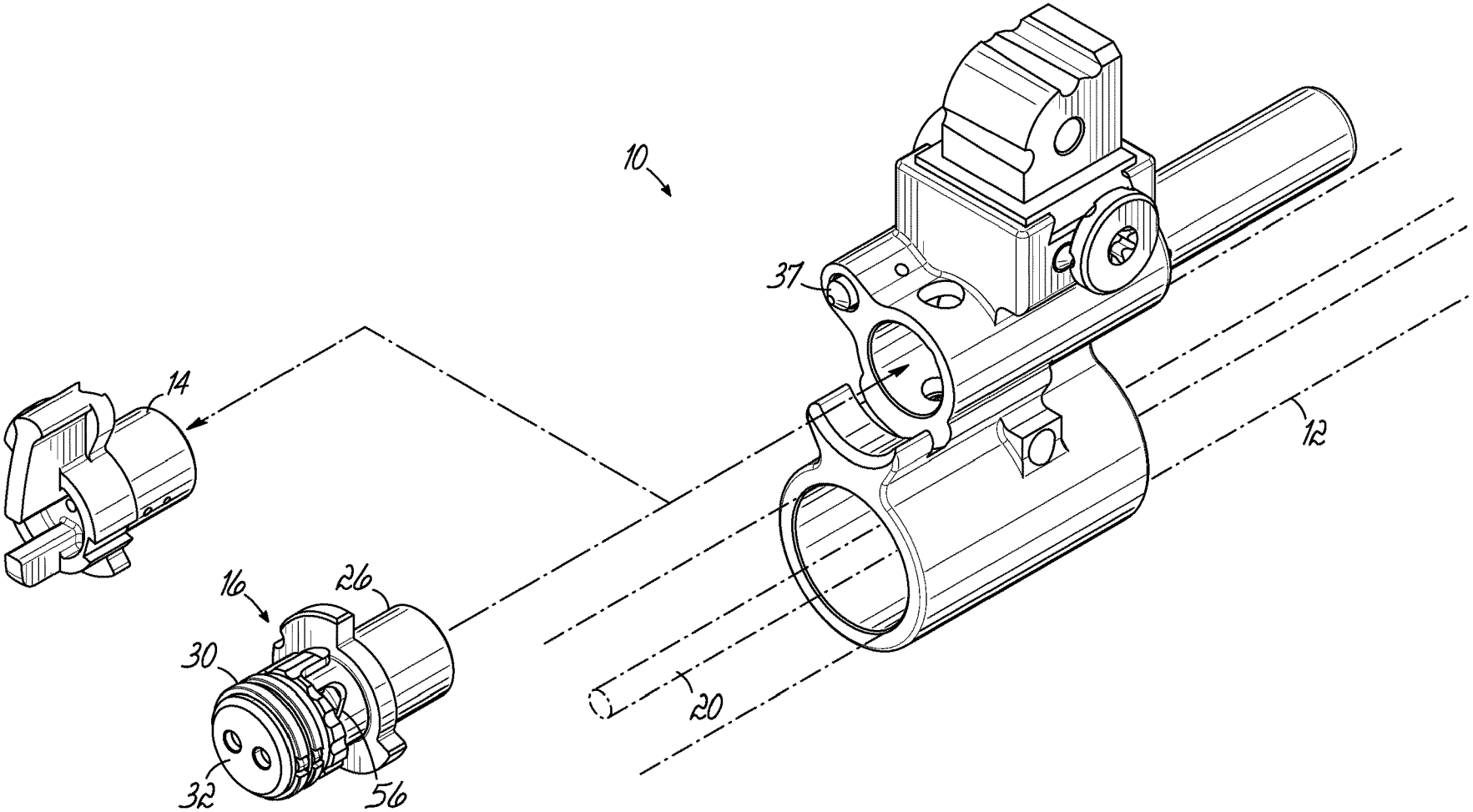
FIG. 1 is an isometric exploded view of a gas block on a barrel (shown in phantom lines) with a prior art gas valve and a replacement gas valve according to a first embodiment of the present invention.

Referring first to FIG. 1, therein is shown a gas block 10 mounted to a barrel 12 according to the SCAR design. The OEM gas valve 14 is shown removed along with replacement of an adjustable gas valve 16 according to an embodiment of the present invention. The OEM gas valve allows adjustment of the flow of gas from the barrel bore into the cylinder by rotating the valve body to align orifices of differing sizes with the gas port of the gas block and vents internal pressure through and open exhaust port in the front of the valve. The structure and operation of a SCAR OEM gas valve is well-known to a person of ordinary skill in the art.

The replacement gas valve 16 fits into the gas block 10 in a manner identical to that of the OEM gas valve 14. The replacement gas valve 16 can be rotationally positioned to close off the gas port 18 from the barrel 12, causing the firearm to operate in a single-shot mode. Or it can be positioned to allow flow from the barrel bore 20 into the cylinder 22 of the gas block 10 through an orifice 24 in the body 26 and to control pressure inside the cylinder 22 by adjustably venting gas pressure through an adjustable exhaust port.

Figure 2:
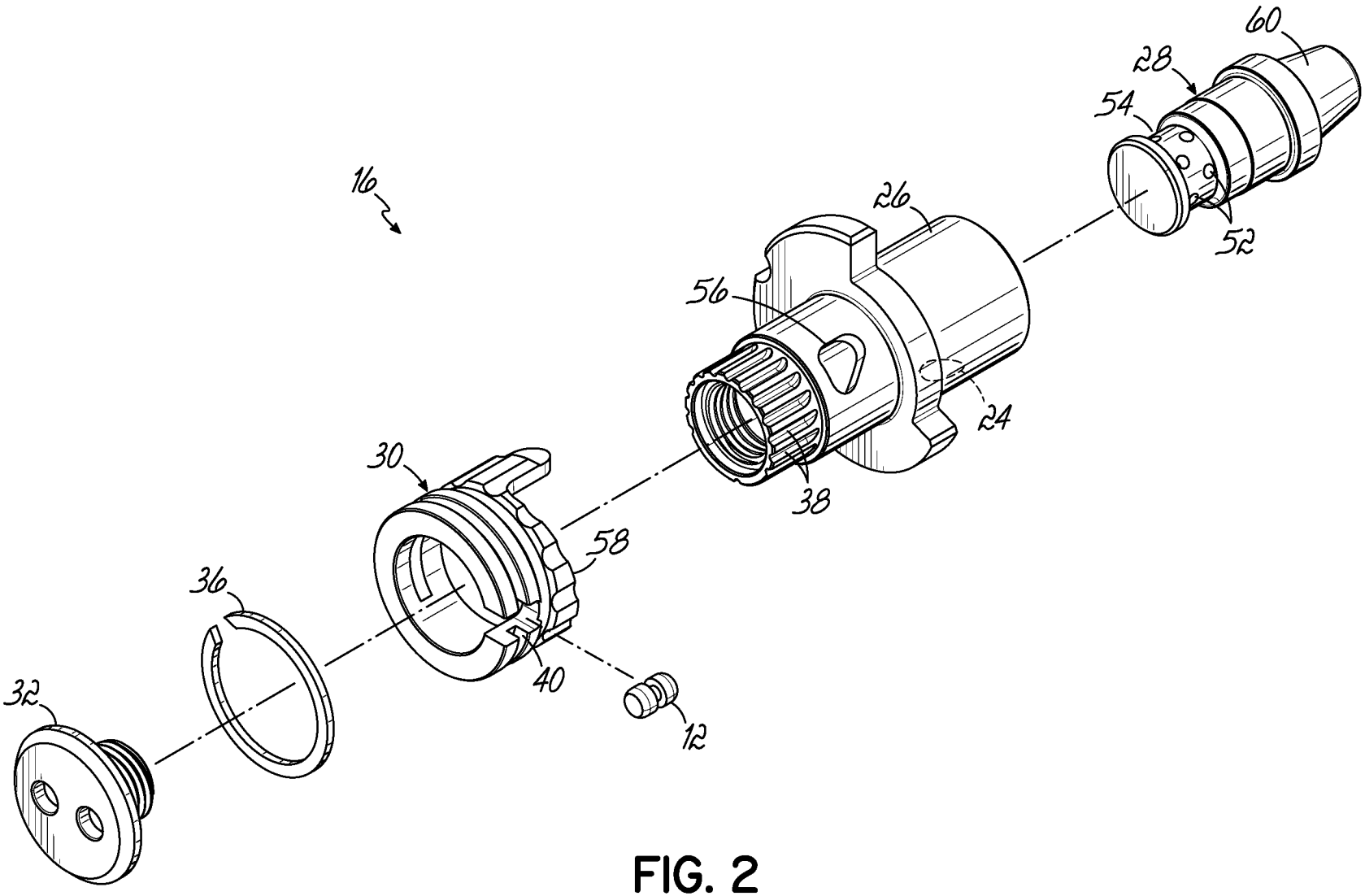
FIG. 2 is an isometric exploded view of the present gas valve.
Figure 3:
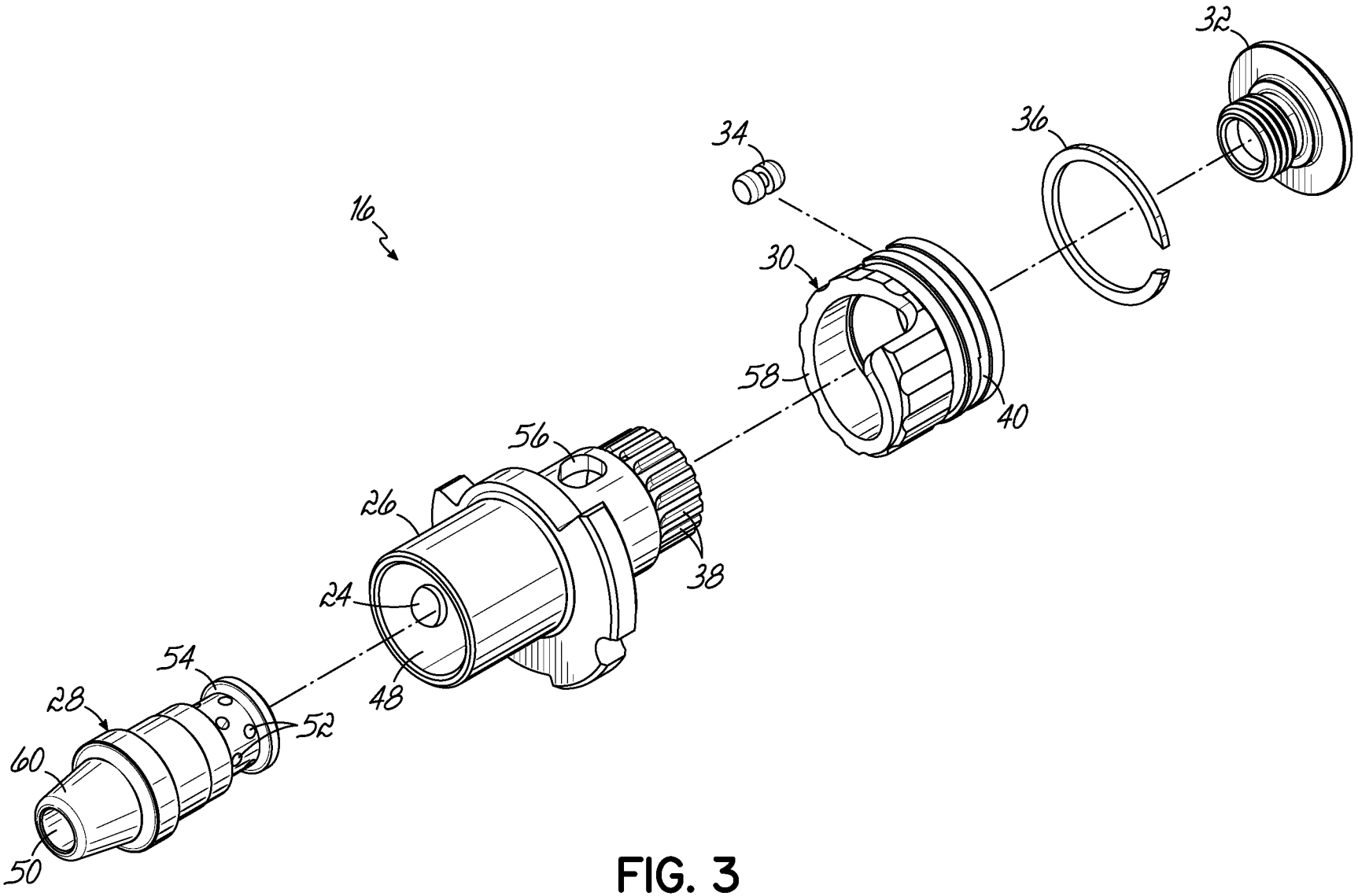
FIG. 3 is an opposite isometric exploded view of the gas valve.

Referring now to FIGS. 2 and 3, the gas valve 16 is shown in an exploded view in which there is a body 26, an internal diffuser stem 28, an adjustment collar 30, a retention screw 32, a detent 34, and a detent spring 36. The body 26 is configured to fit into the gas block 10, as described above. The diffuser stem 28 is inserted into one end of the body 26 and secured with a press-fit connection. The adjustment collar 30 rotatably fit over the opposite end of the body 26 and is secured by the retention screw 32 that threads into internal threads in the body 26. The collar 30 provides rotary adjustment, as described in greater detail below. Rotational position of the collar 30 is maintained by engagement between the detent member 34 and circumferentially placed splines 38 on an exterior surface of the valve body 26. The detent 34 is biased toward engagement against the splines 38 and grooves therebetween by the detent spring 36. In the illustrated embodiment, the detent spring 36 is installed like a snap ring into an annular groove 40 on the collar 30 and over the detent 34. The cylindrical shape of the detent 34 allows it to roll, if necessary, as the collar 30 is rotated and the detent 34 moves over adjacent splines 38 to engage in grooves therebetween.

Figure 4:
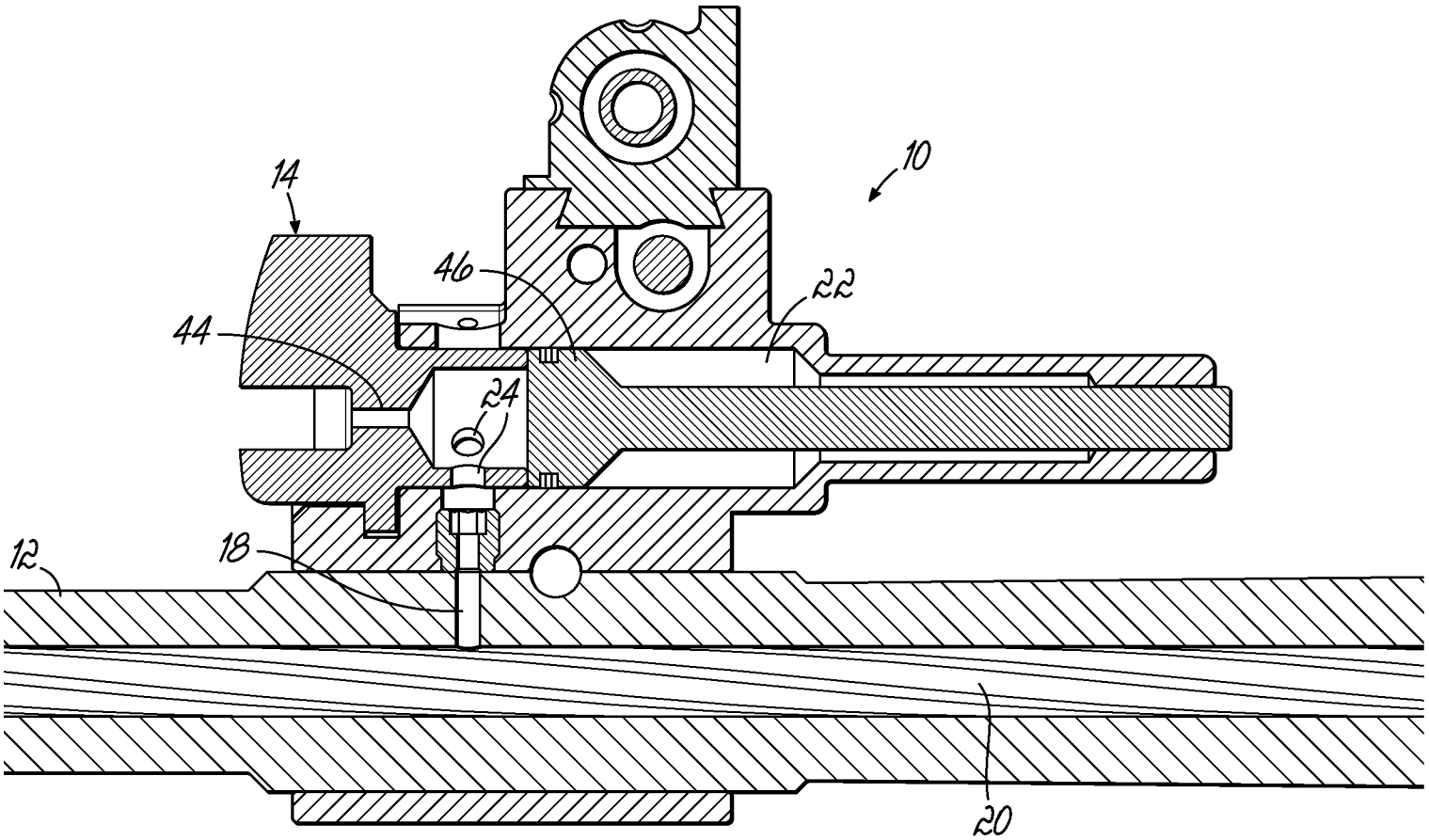
FIG. 4 PRIOR ART
FIG. 4 is a side sectional view of the gas block with a prior art gas valve.

Referring now to FIG. 4, therein is shown a side longitudinal sectional view of the gas block 10 installed on a barrel 12 with an actuation piston 46 in the cylinder 22 and the OEM, prior art gas adjustment valve 14 installed. The prior art valve 14 has a body that can be rotated to multiple positions to adjust flow of gas from the barrel bore 20 through the port 18 and into the cylinder 22. The valve 14 is retained in any on these rotational positions by a detent 37 that is part of the prior art gas block 10. Flow can be controlled by choosing between orifices 24 of preselected sizes, including a position at which gas flow is completely blocked (resulting in single-shot mode). Over-pressure of gas in the cylinder 22 is reduced by venting pressure to atmosphere through a single, nonadjustable, forward-facing exhaust port 44.

FIG. 5 shows a similar view with an embodiment of the adjustable gas valve 16 of the present invention installed in the gas block 10 and FIG. 6 shows an enlarged sectional view of the valve 16 (without the gas block). Referring to FIGS. 5 and 6, high pressure propellant gas flows from the barrel bore 20, through the port 18 and the valve orifice 24. In this illustrated embodiment, the gas valve 16 includes only one inlet orifice 24, since gas pressure is adjustably controlled in a different way. The valve 16 can, however, be rotated so that the barrel port 18 is closed (resulting in single-shot mode). The valve is held in these selected positions by the gas block detent 37. The interior of the valve body 26 provides a chamber 48 that is an extension of the cylinder 22 where gas pressure will bear against the face of the piston 46. Some portion of the gas pressure flows into a central passageway 50 in the stem 28 to be exhausted to atmosphere. The exhaust flow exits the central passageway 48 through a plurality of ports 52 into an annular secondary chamber 54 and escapes the valve body 26 through an exhaust opening 56. Flow through the exhaust opening 56 is controlled by rotation of the collar 30 to change its effective size, as further described below.

The valve diffuser ports 52 may vary in size, number, and/or position. In the illustrated embodiment, they are evenly distributed circumferentially. Exhaust flow is controlled by varying the effective size of the exhaust opening 52. This may be accomplished by rotatably positioning a helical edge 58 of the collar 30 relative to the opening 56. As shown, for example in FIGS. 9-11, the effective area of the opening 56 may be adjusted depending on the rotational position of the collar 30 and its helical edge 58 that can either not occlude (FIG. 9), partially occlude (FIG. 10), or fully occlude (FIG. 11) the opening 56. This provides finer adjustability than the prior art selection between inlet orifices of only a few preselected sizes.

The end shape of the diffuser stem 28 may also contribute to improved performance. The gas flow enters the valve body 26 through a radially positioned orifice 24 into a chamber 48 that functions as an extension of the cylinder 22. Because the expansion of the cylinder chamber volume is axial (by displacement of the piston 46), the substantially conical outer surface 60 of the diffuser stem 28 can help dissipate the flow path and affect the flow into the central passageway 50 for exhaust.

Referring now to FIGS. 12-15, an adjustable gas valve 62 according to a second embodiment is shown in which there is a body 64, an internal diffuser stem 66, a regulator knob 68, a retention screw 70, a detent 72, and a detent spring 74. The function and operation of the embodiment shown in FIGS. 12-15 is in substance the same as the previously described embodiment. In this embodiment, the regulator knob 68 has a helical edge 76 that is internal of the body 64 and exhaust port 78 (rather than external thereof). The body 64 is configured to fit into the gas block 10, as described above. The diffuser stem 66 is inserted into one end of the body 64 and assembled with the regulator knob 68 using the retention screw 70 that threads onto the stem 66. The helical edge 76 of the knob 30 provides rotary adjustment of the effective size of the exhaust opening 78. Rotational position of the 68 is maintained by engagement between the detent member 72 and circumferentially placed splines 80 on an exterior surface of the knob 68. The detent 72 is biased toward engagement against the splines 80 and grooves therebetween by the detent spring 74. In this illustrated embodiment, the detent spring 74 is installed like a snap ring into an annular groove 82 on the body 64 and over the detent 72. The cylindrical shape of the detent 72 allows it to roll, if necessary, as the knob 68 is rotated and the detent 72 moves over adjacent splines 80 to engage in grooves therebetween.

Although the illustrated embodiment is adapted for the SCAR platform, the invention can be adapted for other weapon systems or platforms, as well. The disclosed valve mechanism can be used to meter gas flow and/or pressure into the gas cylinder and/or the exhaust vent.

While specific embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An adjustable gas valve for use in a firearm gas block having a cylinder and piston in the gas block, the valve comprising:

a valve body configured to associate with the cylinder and having an exhaust port, the valve body including a plurality of inlet orifices rotatably alignable to selectively receive gas pressure flow from a barrel port;

a regulator that adjustably occludes between none and all of the exhaust port, and an internal diffuser stem configured to extend at least partially inside the valve body, the internal diffuser stem having an open end directed toward the piston, a plurality of radial exhaust outlets leading to an annular chamber positioned adjacent the exhaust port, and a central exhaust passageway operably connecting the open end with the radial exhaust outlets.

2. The valve of claim 1, wherein the regulator adjusts by rotation.

3. The valve of claim 2, wherein the detent is biased by a snap ring spring fitted in an annular groove.

4. The valve of claim 2, wherein the detent engages splines on another part.

5. The valve of claim 4, wherein the splines are on the valve body and the groove is on the regulator.

6. The valve of claim 4, wherein the splines are on the regulator and the groove is on the valve body.

7. The valve of claim 1, further comprising a spring biased detent configured to hold the regulator in a selected position.

8. The valve of claim 1, wherein the regulator is configured to occlude the exhaust port exterior of the valve body.

9. The valve of claim 1, wherein the regulator is configured to occlude the exhaust port inside the valve body.

10. The valve of claim 1, wherein the valve body includes a plurality of alignable inlet orifices rotatably positionable to vary gas pressure flow from the barrel port.

11. The valve of claim 10, wherein the valve body is further alignable to occlude gas pressure flow from the barrel port.

12. An adjustable gas valve for use in a firearm gas block having a cylinder and piston in the gas block, the valve comprising:

a valve body configured to associate with the cylinder and having an exhaust port;

a regulator that adjustably occludes between none and all of the exhaust port; and further comprising an internal diffuser stem configured to extend at least partially inside the valve body, the internal diffuser stem having a central exhaust passageway, an open end directed toward the piston, and a plurality of radial exhaust outlets proximate an end opposite the open end, wherein a portion of the internal diffuser stem has an outer surface adjacent the open end that includes a conical outer surface defining an annular space between the conical outer surface and the valve body.

13. The valve of claim 12, wherein the valve body includes a plurality of alignable inlet orifices rotatably positionable to vary gas pressure flow from the barrel port.

14. The valve of claim 13, wherein the valve body is further alignable to occlude gas pressure flow from the barrel port.

* * * * *